United States Patent [19]

Carlson et al.

[11] 4,077,480

[45] Mar. 7, 1978

[54] ONE MAN OPERATED, TWIN WHEEL MOUNTED POWERED EARTH DRILL

[75] Inventors: Paul R. Carlson, San Bernardino; Richard L. Carlson, Yucaipa, both of Calif.

[73] Assignee: Ground Hog, Inc., San Bernardino, Calif.

[21] Appl. No.: 703,459

[22] Filed: Jul. 8, 1976

[51] Int. Cl.[2] ..... E21C 11/02

[52] U.S. Cl. ..... 173/22; 173/163

[58] Field of Search ..... 173/22, 26, 38, 140, 173/163, 165, 166; 175/170

[56] References Cited

U.S. PATENT DOCUMENTS

| | | | |
|---|---|---|---|
| 2,576,199 | 11/1951 | Vogel | 173/26 |
| 2,604,304 | 7/1952 | Wilson | 173/163 |
| 2,673,452 | 3/1954 | Glaze | 173/163 |
| 2,815,049 | 12/1957 | Herscovitch | 173/22 |
| 3,232,168 | 2/1966 | Manberg et al. | 175/170 |
| 3,604,521 | 9/1971 | Collins | 173/38 |
| 3,731,751 | 5/1973 | Rusco | 173/26 |
| 3,976,147 | 8/1976 | Cunningham | 173/22 |

*Primary Examiner*—Robert A. Hafer
*Attorney, Agent, or Firm*—Dana E. Keech

[57] ABSTRACT

Quarter inch plate steel forms the bottom, front and rear walls of a U-shaped open sided saddle for mounting therewithin a 9 H.P. four cycle gasoline engine, the bottom of said saddle being clamped along its front edge to a 30 inch fixed axle on opposite ends of which are freely rotatable 14 inch diameter ballon tired wheels. Rectangularly rigidly connected to upper ends of said spaced rear and front engine saddle walls and continuing 46 inches forwardly therefrom is an inverted 4 inch square U-cross section sheet metal channel providing a drill supporting tongue for the tool while also housing a main shaft, the rear end of which journals in a self-aligning bearing fixed rockably on said rear engine saddle wall. Behind said wall said main shaft has a driven pulley fixed thereon which is belt driven from an engine shaft drive pulley when a manually controlled idler roller clutch means tightens the connecting belt.

Rockably mounted on a transverse axis on the front end of said inverted channel shaft housing is a worm gear box, the short horizontal input shaft of which connects through a universal spline joint with the front end of said main shaft. The short vertical downward output shaft of said gear box is squared for readily connecting the same to an earth drill of selected length and diameter.

A pair of handle bars equipped respectively with clutch and throttle controls is also mounted on the top of a front portion of said shaft housing. These bars are readily shiftable to any one of three optional positions for the convenience of the operator in various phases of earth drilling with the invention.

10 Claims, 8 Drawing Figures

ONE MAN OPERATED, TWIN WHEEL MOUNTED POWERED EARTH DRILL

SUMMARY OF THE INVENTION

Although the applicant has for many years been prominent in the manufacture of light gasoline engine powered earth drills in which the entire tool is supported by the operator or several operators and they also must bear the entire reaction produced by the drilling torque, only recently has thought in this field been turning to replacing such tools with a lightweight inexpensive powered drill which will decrease the rigor imposed on the operator.

It is accordingly an object of the present invention to provide a twin air tired wheel supported engine powered earth drill most of the weight of which is borne by the wheels. For instance, the preferred embodiment disclosed herein weighs 185 pounds and only 35 pounds of this must be lifted by the operator in moving the tool from place to place.

Perhaps the closest prior art reference to be found in the field of the present invention is the U.S. patent to W. Herscovitch, U.S. Pat. No. 2,815,049 which issued on Dec. 3, 1957. The powered drill there disclosed, (Patent FIGS. 7, 8, 9 and 10) is heavy, complex and expensive to build. It is thus a prime purpose of the present invention to eliminate weight, complexity and cost in the final manufactured product embodying this invention.

Still another object is to incorporate means in the present invention which will allow the operator the optional choice between a multiplicity of different handle bar positions in manipulating the tool so as to minimize the physical burdens involved.

In particular, it is an object to provide handle bars (a) in a forwardly extending downwardly inclined position permitting the operator to support the tool (including the attached drill) entirely above the ground, while shifting the tool between drilling locations, and yet with the arms relaxed and extended downward;

(b) in a forwardly extended high position facilitating applying the operator's weight to assist in speeding up the rate of drilling; and (c) in a rearwardly extended position parallel with the main shaft housing permitting the operator being properly located for drilling a hole close to a tree, stone, wall or fence.

Still another object is to provide such a single man operated powered earth drill in which the optional choice of handle bar positions aforesaid is realized through a single pair of handle bars provided to be quickly adjusted to occupy any position selected and automatically locked in that position until deliberately moved.

A yet further object of the invention is to provide such an adjustable pair of handle bars which are equipped respectively with clutch and throttle controls which are equally effective in all handle bar positions.

BRIEF DESCRIPTION OF THE DRAWINGS

FIG. 4 is a view similar to FIG. 3 and shows the handle bars rocked rearwardly into reversed parallelism with the main shaft housing and latched in the position as when drilling a hole close to a wall, fence, hedge or the like.

DETAILED DESCRIPTION OF THE PREFERRED EMBODIMENT

Figure 1:
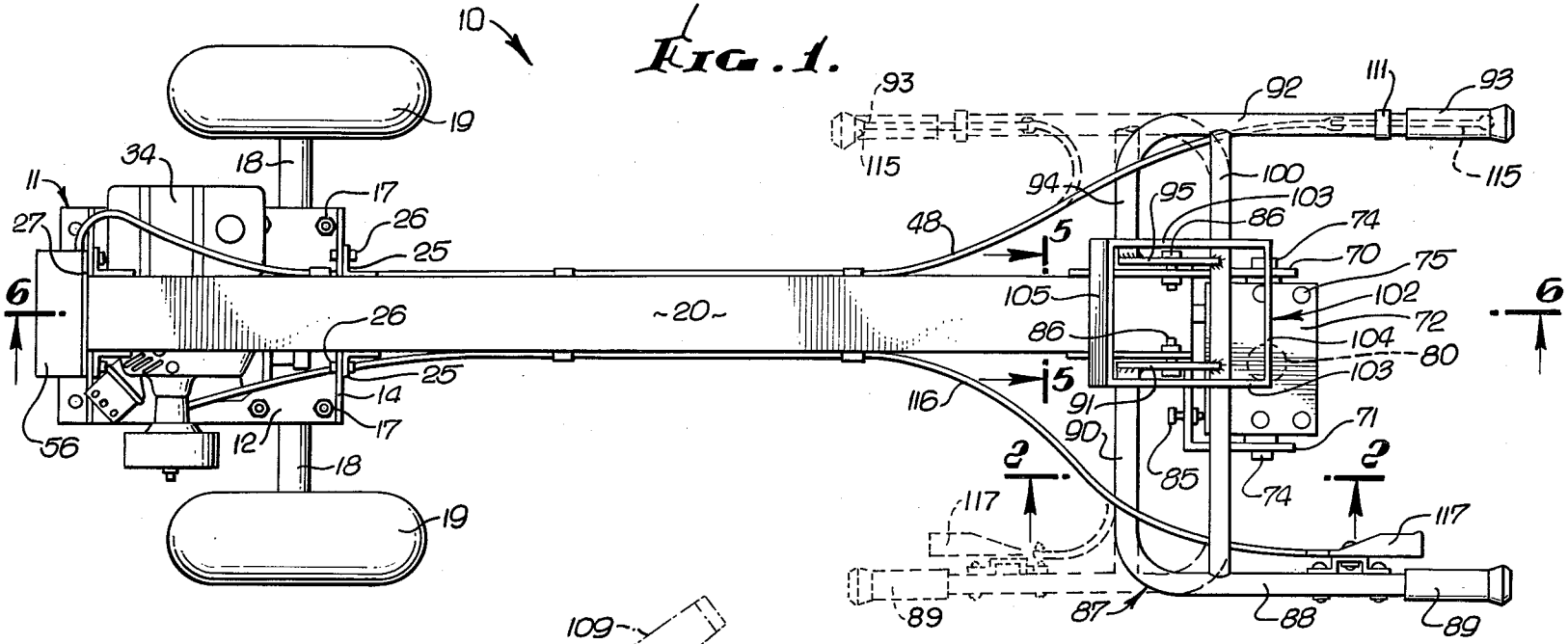
FIG. 1 is a plan view of a preferred embodiment of the invention positioned horizontally and with the handle bars extending forwardly parallel with the main shaft housing. This view also shows in broken lines the handle bars extending rearwardly parallel with said shaft housing and illustrates the asymmetric relation of the handle bars with said housing.

The tool 10 of the invention includes an open sided engine saddle 11 having a rectangular bottom 12 and parallel upwardly tapering rear and front walls 13 and 14 all three of which are made of quarter inch steel plate. The rear wall 13 is secured to the housing bottom 12 by a flange 15 and bolts 16 while the front wall 14 is welded at its lower edge to the front edge of the bottom 12. The bottom 12 is secured by U-bolts 17 near its front edge to a tubular axle 18 which is about 30 inches long and has rotatably fixed on its opposite ends twin balloon tired wheels 19 which are approximately 14 inches in diameter.

Saddle walls 13 and 14 are suitably apertured centrally at their upper ends to receive a rear end portion of an inverted 4 inch square U-cross section sheet metal channel main shaft housing 20 having flanges 25 welded thereto and secured by bolts 26 to said walls. Said housing extends forwardly 60 inches parallel with the engine saddle bottom 12 to also provide a main tongue for the tool 10. The rear end of said shaft housing abutts against a bearing mounting plate 27 which is secured to the rear housing wall 13 by certain of the bolts 26. Mounted on the forward face of the plate 27 by two bolts 28 is a self-aligning bearing 29, the normal axis of rotation of which is concentric with said shaft housing 20. Said housing encloses a main shaft 30 which is co-extensive in length with said housing and the rear end of said shaft is reduced in diameter to be snugly received in the inner face of self-aligning bearing 29 and extend rearwardly beyond the plate 27 to have fixed thereon a driven pulley 31.

The rear saddle wall 13 also has an opening 32 for receiving the output drive shaft 33 of an internal combustion engine 34 which rests upon and is bolted to the engine saddle bottom 12. Mounted on the drive shaft 33 is a drive pulley 35 which is connected to the driven pulley 31 by an endless belt 40. This belt is normally slack so as to be ineffective to transmit power from the drive pulley 35 to the driven pulley 31 and is adapted to be tightened however to effect such transmission of power by the application to said belt of an idler roller 41 which is rotatably mounted on the end of a bell crank 42 which is pivotally fixed at 43 to the engine saddle wall 13 and is normally biased in inactive position by a spring 44. A control wire 45 having a knob 46 on its end pulls on a lug 47 fixed on bell crank 42 so as to permit the operator of the tool 10 to apply power from the engine 34 to the shaft 30 at will. The control wire 45 extends through a flexible tube 48 which leads to the front end of the tool 10 in a manner to be made clear hereinafter. The rear end of the tube 48 is secured to engine saddle wall 13 by a lug 49 (see FIG. 7). Studs 50 are welded on the rear face of wall 13 and extend rearwardly therefrom alongside the endless belt 40 so as to prevent the belt jumping from the pulleys 31 and 35 when the belt is slack.

The transmission 55 just described as being mounted on the engine saddle back wall 13 is normally enclosed by a light metal box forming a dust cover 56 which is secured in place by three bolts 57, 58 and 59.

The main shaft housing 20 is open along its bottom face throughout its length and is reinforced throughout most of its length by a pair of sheet metal bracing strips 60 (see FIG. 5) which are positioned as shown and then welded into the internal corners of the housing. At its forward end the housing 20 has secured thereto by bolts 61, a pair of mounting plates 62 and 63, each of which has a handle bar mounting ear 64 extending upwardly therefrom and a latch frame mounting stud 65 extending co-axially laterally therefrom. The mounting plate 62 has formed thereon and extending forwardly from the lower portion of its front edge a gear box supporting arm 70 while the mounting plate 63, on the right side of the tool has a dog leg shaped arm 71 extending to the right and then forwardly so that apertures provided in the two arms 70 and 71 are transversely concentric with each other. A gear box cap plate 72 having downward bent arms 73 at its end fits between the arms 70 and 71 and is pivotally secured to the arms 70 and 71 by bolts 74. Partially enclosed by the cap plate 72 and secured thereto by bolts 75 is a worm gear box 76 which is of well known construction and is of the type providing a horizontal input shaft 77 and, offset therefrom, a vertical output shaft 78. The front end of main shaft 30 is provided with a spline universal joint unit 79 which connects the front end of said shaft with the input shaft 77 of gear box 76. Output shaft 78 is square and suitably apertured to receive a pin and thus renders it easily connectable with standard earth drills 80 provided for use by light weight earth boring tools such as the tool 10.

Mounted in a suitable tapped hole provided in the gear box supporting arm 71 is a stop screw 85 which is adjusted to engage the gear box 76 to properly limit the rocking of this box about the bolts 74.

Pivotally mounted on bolts 86 connecting the same to handle bar pivot ears 64 is a set of handle bars 87. The latter is assymetrical with the shaft housing 20 and approximately symetrical with the output shaft 78 of the worm gear box 76. It includes a right handle bar 88 having a handle grip 89 and the rear end 90 of which is turned inwardly and is welded to the rear end of a pivot plate 91. The set of handle bars 87 also includes a left handle bar 92 which has a hand grip 93 and the rear portion 94 of which turns inwardly and is welded to the rear end of a left handle bar pivot plate 95. The right and left handle bars 88 and 92 are formed on 1 inch O.D. tubing and are connected integrally by a straight similar piece of tubing 100 which extends entirely across the set of handle bars 87 and is welded at its opposite ends to left and right handle bars 88 and 92 and is also welded to the front ends of right and left pivot plates 91 and 95.

Latch frame pivot studs 65 are provided with tapped holes for receiving screws 101 on which is pivotally mounted a handle bar latch frame 102. This frame includes a pair of latches 103 which are joined together at their front end by a cross bar 104 and near their rear ends by a cross bar 105. The individual latches 103 are alike in structure, each including a rear latch notch 106 and a front latch notch 107.

Figure 5:
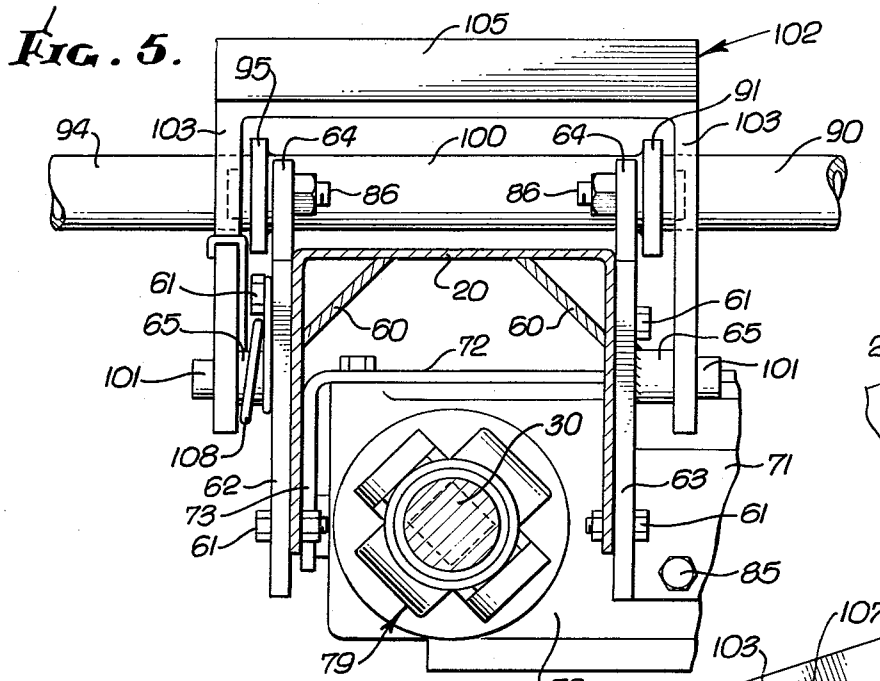
FIG. 5 is an enlarged detail sectional view taken on line 5—5 of FIG. 1 to illustrate the structure of the handle bars, the latch frame and its biasing spring.

As shown in FIG. 5, the left latch frame pivot stud 65 has wound thereabout a coil spring 108, one end of which is held fast by an adjacent screw 61 and the other end of which is hooked around the adjacent individual latch 103 so as to spring bias the handle bar latch frame 102 into whatever latching position it might be placed in by the operator. In order to change the set of handle bars 87 from one of its positions to a different position, it is necessary to take hold of the handle bar latch frame 102 and shift it into its broken line position 109 shown in FIG. 2 thereby releasing the handle bars 87 from control by the latch frame.

Figure 2:
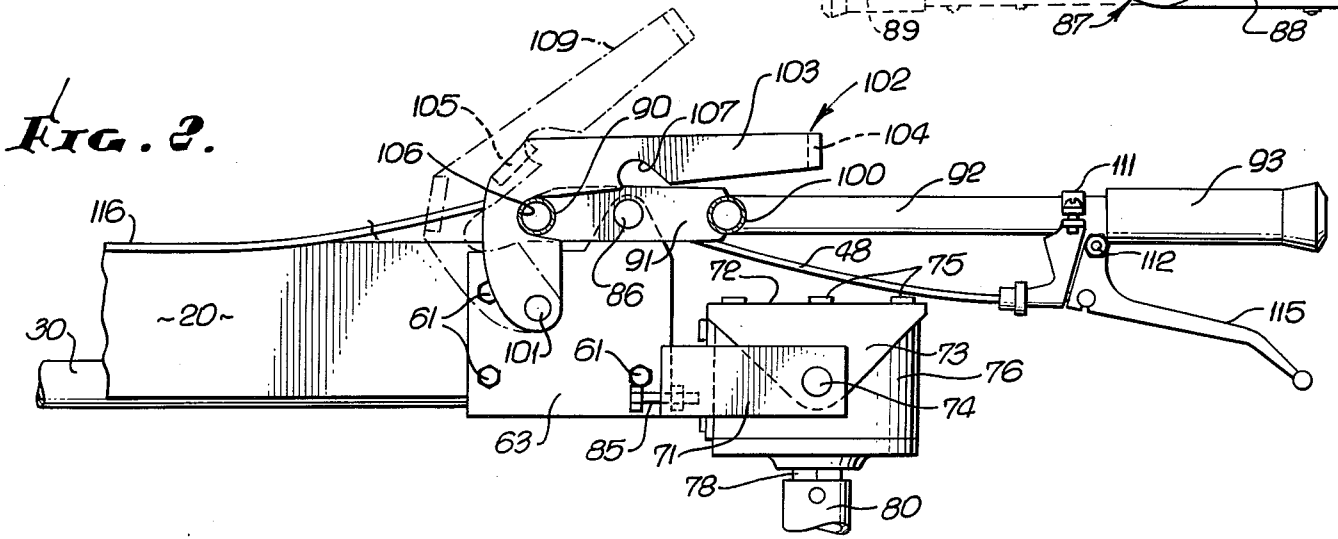
FIG. 2 is an enlarged fragmentary sectional detail view taken on line 2—2 of FIG. 1 and showing the latch frame in broken lines in its retracted position.
Figure 3:
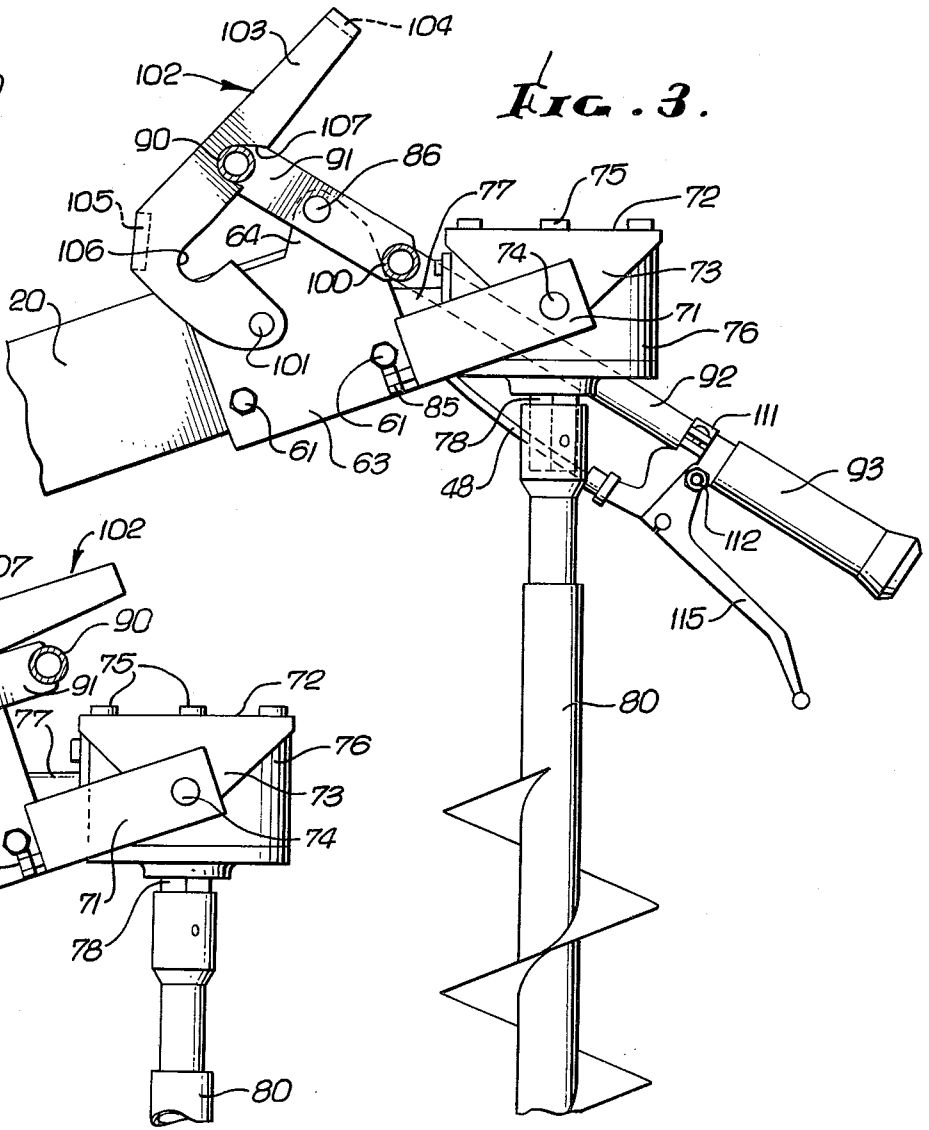
FIG. 3 is a view similar to FIG. 2 showing the main shaft housing upwardly inclined as it would be when shifting the tool from position to position, and with the handle bars optionally locked in forwardly downwardly slanted position as would be helpful to the operator in such circumstances.
Figure 4:
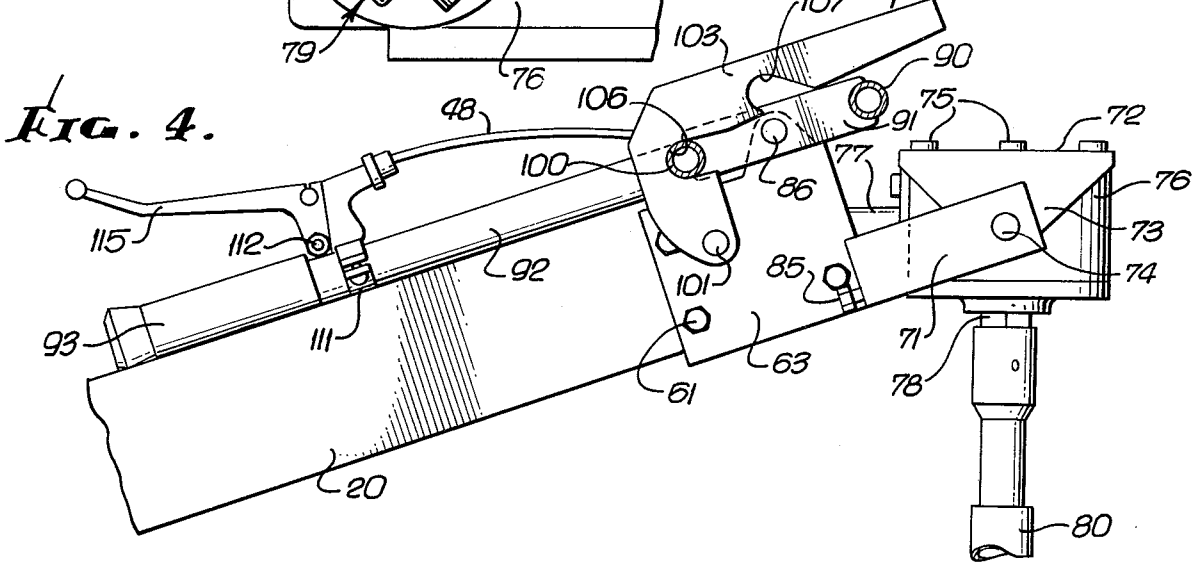
Figures 6, 7, 8:
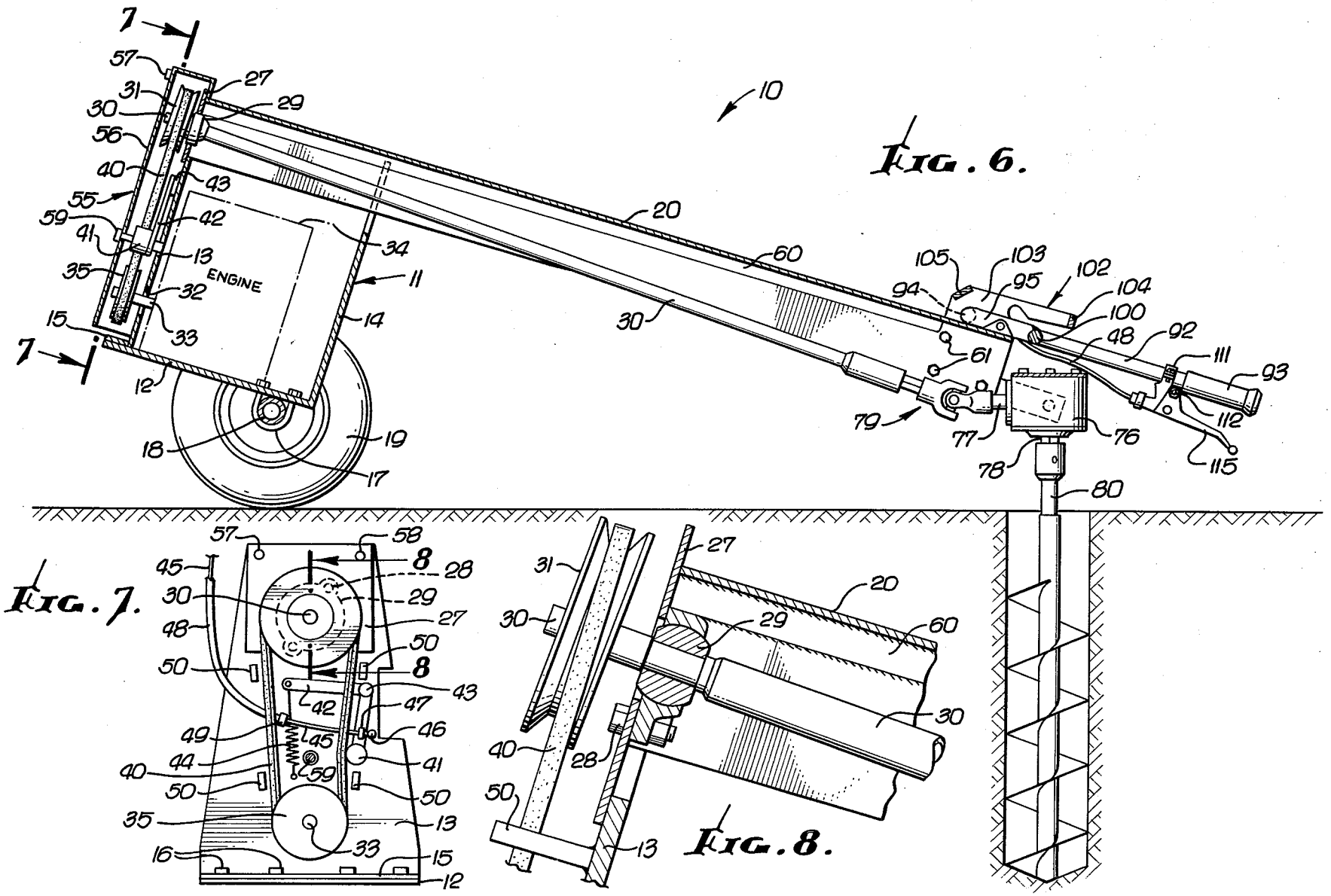
FIG. 6 is a longitudinal vertical sectional view of the invention taken on line 6—6 of FIG. 1 and with the invention inclined forwardly at the conclusion of a hole digging operation and illustrating the operation of the main shaft and its self-aligning bearing, spline-universal joint and the pivotally mounted worm-gear box connecting said shaft to the earth drilling auger.
FIG. 7 is an enlarged detailed sectional view of the clutch and transmission of the invention and is taken on the line 7—7 in FIG. 6.
FIG. 8 is an enlarged cross sectional view of the self-aligning main shaft rear end bearing and is taken on the line 8—8 in FIG. 7.

The three positions in which handle bars 87 may be latched by the latch frame 102 are illustrated in FIGS. 2, 3 and 4. In the first of these positions, shown in FIG. 2, the handle bars are extending straight forwardly in a plane parallel with the main shaft housing 20 and are held in this position by the rear transverse portions 90 and 94 of the right and left handle bars 88 and 92 being caught within the rear latch notches 106 of the latch frame 102. This position of the handle bars is particularly useful to the operator in giving him two high points at the front end of the tool 10 upon which he can apply his weight downwardly with both hands to apply pressure to the tool 10 in drilling a hole. FIG. 6 also illustrates the advantage of this position of the handle bars 87 right down to the finishing of a hole.

The position of the handle bars 87 shown in FIG. 3 is accomplished by depressing the handle bars 87, when freed from the latch frame 102, to a downwardly inclined position in which the handle bar portions 90 and 94 will be trapped in latching notches 107 of the latch frame 102 as shown in FIG. 3, and is particularly useful in giving two low points on the tool 10 which can be gripped by the operator in lifting the front end of the tool with a drill 80 attached to the gear box for moving the tool from one drilling position to another on the job.

The third position in which the handle bars 87 may be latched is shown in FIG. 4 and this position is accomplished by rotating the handle bars reversely about their pivot screws 86, while freed from encumbrance by the latch frame 102, so as to admit the cross bar 100 of the handle bars 87 within the latch notches 106 of the latch frame 102 when the latch frame is released so as to be spring biased into latching relation with said cross bar. This position of the handle bars 87 is of particular utility to the operator of the tool 10 when required to drill a hole in which the drill 80 must be located close to a large rock or fence or tree or similar obstacle which would not permit the handles to extend forwardly from the tool as shown in FIGS. 2 or 3, and in which some means must be provided for the operator to manipulate the tool while at the same time controlling the power transmission 55 and the throttle of the engine 34.

For accomplishing the latter purpose, the left handle bar 92 is provided with a fitting 111 which is clamped thereon and has pivotally mounted thereon at 112 a lever 115 which is connected to the front end of control wire 45 so that whatever position the handle bars 87 may be in, in the operation of the machine 10, the operator has lever 115 available for causing the engagement of the transmission 55 to apply power from the engine 34 to the drill 80.

In a like manner, the throttle of engine 34 is connected by a suitable cable 116 to a throttle lever 117 mounted on right handle bar 88 adjacent to the grip 89 so that the operator may at all times, in handling the tool 10, be able to selectively connect the engine with the drill and govern the speed at which the engine drives the drill by manipulation of the throttle lever 117.

It is to be noted that when the handle bars 87 are in their rearwardly reversed position as shown in FIG. 4, the levers 115 and 117 are disposed upwardly instead of downwardly as is the case in the other two positions of the handle bars 87 so that when using the handle bars as shown in FIG. 4, this difference needs to be taken into account and the operator of course can readily adapt himself to this difference when operating a tool from behind the drill 80.

Attention is also directed to the advantages derived from employing a worm and gear power transmission box 76 in the tool 10. In the first place, this feature very substantially reduces the size of the gear box over the types of gear boxes previously used in this art. This greatly reduces the amount of vertical movement of the front end of shaft 30 incidental to the tool digging a hole in the ground. The shaft 30 thus remains at all times covered by the housing and tool tongue 20 which, in turn, permits the rear end of the shaft to be journalled in and supported by the self-aligning bearing 29 thereby eliminating the need of a second universal joint in the shaft. The asymmetrical location of the drill 80 with reference to shaft housing 20 caused by the use of worm and gear box 76 resulted in shifting the center of handle bar means 87 to be approximately symmetrical with drill 80. The operator is thus symmetrically related to the drill when standing in front of the tool to operate the same. Furthermore, when standing behind the drill to operate the tool and with the handlebars fixed in their rearward horizontal position, as shown in broken lines in FIG. 1, the asymmetric relation of the handlebar means to the shaft housing 20 makes it much more convenient for the operator to stand close to said housing on the right side thereof on account of handle bar 88 being spaced much farther from the near side of shaft housing 20 than the handlebar 92 is spaced from the opposite side of said housing.

We claim:

1. In a one man operated twin wheel mounted powered earth drilling tool, the combination of:

axle means mounting a pair of small air tired wheels on its opposite ends;

a U-shaped engine saddle including an engine supporting platform fixed on said axle means and two parallel tranverse walls rigidly fixed respectively to front and rear edges of said platform at right angles therewith and extending equal distances upwardly therefrom;

engine means seated on and rigidly secured to said saddle with its center of gravity rearward of said axle means, said engine means having an output pulley means extending rearwardly therefrom;

an elongated inverted deep sheet metal channel member constituting a tongue for manipulating said tool and a downwardly open main shaft housing therefor, a rear end integral portion of said member overlying said saddle and being rigidly united with upper ends of said two transverse engine saddle walls so as to be parallel with said platform and extend forwardly from said saddle a substantial distance;

a self-aligning bearing mounted on said rear transverse engine saddle wall in general alignment with said shaft housing member;

a main shaft covered by and co-extensive with said shaft housing and having its rear end supported by and journalling in said self-aligning bearing;

power transmission means connecting said engine output pulley means to a rearward portion of said main shaft to drive the latter;

a gear box having a horizontal high speed input shaft and a vertical downward low speed output shaft;

means mounted on the forward end of said main shaft housing inverted channel member for pivotally supporting said gear box on a transverse axis;

a splined universal joint unit embodied in the forward end of said main shaft and connected to the input shaft of said gear box, said output shaft having means for readily connecting an earth drill thereto; and handle bar means provided on said main shaft housing for manually guiding said tool while earth drilling.

2. A combination as recited in claim 1 wherein said engine drive shaft is parallel with said shaft housing and extends rearwardly through the back wall of said engine saddle; and wherein the rear end portion of said main shaft protrudes rearwardly from said rear wall; and wherein said power transmission means in cludes pulleys fixed on said shaft ends extending rearwardly from said rear wall of said engine saddle, an endless belt trained about said pulleys, means for tightening said belt to transmit power to said main shaft from said engine, and relaxing said belt to disengage said transmission, and cable means operable from the front end of said main shaft housing enabling the operator standing at the front of said tool to engage or disengage said transmission at will.

3. A combination as recited in claim 2 wherein manual lever means is mounted on said handle bar means for manually controlling said transmission while the operator is employing said handle bar means to manipulate said tool; and means for rotatably mounting said handle bar means on a transverse axis on said shaft housing and for rigidly latching said handle bar means in either of two positions in one of which said handle bar means are pointed forwardly for siezure by the operator in front of said gear box and drill and in the other of which positions said handle bar means are pointed rearwardly for siezure by the operator behind said gear box and drill thereby allowing said handle bar means to be optionally shifted between and latched in place in one or the other of said operative tool manipulating positions without impairing the effectiveness of said power transmission control lever means.

4. A combination as recited in claim 3 wherein said handle bar means is rotatably mounted on a transverse axis on the forward end of said main shaft housing means so that the handle bar means may be optionally latched in any of three positions, in the first of which said handle bar means are pointed forwardly and downwardly inclined from the front end of said shaft housing means, in the second of which said handle bar means are pointed straight forward parallel with said shaft housing means, and in the third of which said handle bar means are extended rearwardly from their pivotal point of attachment to said shaft housing means and are approximately parallel with the latter; and latch means pivotally mounted on said shaft housing means and spring biased into engagement with said handle bar means so as to readily latch the latter in any of the above three positions when it arrives therein.

5. In a one man operated twin wheel mounted engine powered earth drill, the combination of:

a transverse axle means mounting a pair of small air tired wheels on its opposite ends;

engine saddle means mounted on said axle means between said wheels;

engine means mounted within said saddle means;

an elongated hollow sheet steel tongue member rigidly mounted on top of said saddle means and extending forwardly therefrom a substantial distance;

a worm-gear transmission box having a horizontal high speed input shaft and a vertical downward low speed output shaft the axes of said shafts being horizontally spaced laterally a distance equal to the sum of the pitch radii of the worm and gear components in said box;

means mounted on the forward end of said tool tongue member for pivotally supporting said worm-gear box on a transverse axis approximately intersecting said worm-gear axes;

a self-aligning bearing mounted within the junction between said tongue member and said engine saddle and aligned with said member;

a main shaft covered by and co-extensive with said tongue member and having its rear end journally in said self-aligning bearing;

a splined universal joint unit embodied in the forward end of said main shaft and connected to the input shaft of said worm-gear box, said output shaft having means for suspending an earth drill therefrom;

power transmission means connecting said engine means to a rearward portion of said main shaft to drive the latter;

handle bar means including integrated right and left handles;

means for rotatably mounting said handle bar means on a transverse axis on said tongue member at its front end and for rigidly latching said handle bar means in either of two positions, in one of which said handle bar means are pointed forwardly for siezure by the operator in front of said worm-gear box and drill, and in the other of which positions said handle bar means are pointed rearwardly for siezure by the operator behind said gear box and drill; and means accessible to the operator in either of said locations for controlling said power transmission means, to cause or to halt the rotation of said drill by said engine means.

6. A combination as recited in claim 5 wherein said handle bar means are approximately symmetrical with reference to said output shaft and drill in said first or forward position and correspondingly asymmetrical with reference to said tongue member in said second or rearward position thereby affording in the latter case an increased space between said tongue member and one of said handles to accommodate the operator's body when he is stationed behind said handle bar means with the latter in said second position.

7. A combination as recited in claim 6 wherein said handle bar means is parallel with said tongue member in each of its optional positions aforesaid, and has another optional position, in which it may be selectively latched, with said handle bar means declining forwardly steeply.

8. A combination as recited in claim 7 wherein said means accessible to the operator for controlling said power transmission means are mounted on one of the separate handles of said handle bar means; and means for controlling the throttle of said engine means, mounted on the other of said separate handles.

9. A combination as recited in claim 5 wherein said tongue member is approximately square in cross section and is reinforced through most of its length by sheet metal bracing strips applied inwardly to cover the internal corners of said member and welded into place.

10. A combination as recited in claim 5 wherein said handle bar mounting and latching means includes:

a pair of plates secured by bolt means to opposite sides of a front end portion of said tongue;

a pair of transversely aligned handle bar pivot ears extending upward from said plates;

a pair of transversely aligned latch frame pivot mounting studs extending laterally from said plates on an axis located a substantial distance downwardly and rearwardly from the axis of said pivot ears;

a pair of pivot plates disposed laterally just outside of said pivot ears and rotatably mounted thereon by bolt means located at midpoints in said pivot plates;

a tubular handle bar frame providing parallel separate right and left handles, rear ends of which bend inwardly into welded union respectively with the rear ends of said rotatable pivot plates, and a straight, integrating cross tube outer ends of which abut against and are welded to said right and left handles while intermediate portions of said cross tube contact and are welded to front ends of said rotatable pivot plates;

a latch frame including a pair of like latches each individually pivotally mounted on its lower end on one of said latch studs, and rigidly joined together by cross bar means, said latches providing a pair of rear notches and a pair of front notches which are optionally engagable with different portions of said tubular handle bar frame to selectively fix said frame in one or the other of a multiple of different positions; and means biasing said latch frame into latching engagement with said handle bar frame with the latter placed in whichever of said positions has been selected.

* * * * *